US008088194B2

(12) United States Patent
Tsutsumi et al.

(10) Patent No.: US 8,088,194 B2
(45) Date of Patent: Jan. 3, 2012

(54) METHOD FOR PRODUCING HOT BRIQUETTE IRON USING HIGH-TEMPERATURE REDUCED IRON AND METHOD AND APPARATUS FOR CONTROLLING TEMPERATURE OF REDUCED IRON FOR HOT FORMING

(75) Inventors: Hirofumi Tsutsumi, Kobe (JP); Yutaka Miyakawa, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 19 days.

(21) Appl. No.: 12/679,220

(22) PCT Filed: Sep. 5, 2008

(86) PCT No.: PCT/JP2008/066044

§ 371 (c)(1),
(2), (4) Date: Mar. 19, 2010

(87) PCT Pub. No.: WO2009/037982

PCT Pub. Date: Mar. 26, 2009

(65) Prior Publication Data

US 2010/0224028 A1 Sep. 9, 2010

(30) Foreign Application Priority Data

Sep. 19, 2007 (JP) ..... 2007-242649

(51) Int. Cl.
*C22B 1/24* (2006.01)

(52) U.S. Cl. ..... 75/380; 75/436; 75/770; 23/313 R; 264/125; 148/514; 432/116; 266/87; 266/173; 266/190

(58) Field of Classification Search ..... 75/436, 75/380, 770; 264/125; 23/313 R; 148/514; 432/116; 266/87, 173, 190
See application file for complete search history.

(56) References Cited

U.S. PATENT DOCUMENTS

| | | | | |
|---|---|---|---|---|
| 4,533,384 | A * | 8/1985 | Rellermeyer et al. | 75/765 |
| 6,030,434 | A | 2/2000 | Zuloaga et al. | |
| 6,368,379 | B1 | 4/2002 | Tateishi et al. | |
| 2003/0019548 | A1 | 1/2003 | Miyagawa et al. | |

FOREIGN PATENT DOCUMENTS

| | | |
|---|---|---|
| JP | 52 78610 | 7/1977 |

(Continued)

OTHER PUBLICATIONS

Machine translation of JP 2001-330379 A published Nov. 30, 2001.*

(Continued)

*Primary Examiner* — George Wyszomierski
*Assistant Examiner* — Tima M McGuthry Banks
(74) *Attorney, Agent, or Firm* — Oblon, Spivak, McClelland, Maier & Neustadt, L.L.P.

(57) ABSTRACT

Provided is a method for producing hot briquette iron by hot-forming high-temperature reduced iron reduced in a reducing furnace, involving cooling the high-temperature reduced iron and controlling the temperature of the reduced iron to an appropriate hot-forming temperature of over 600° C. and 750° C. or less, producing hot briquette iron by hot-forming the high-temperature reduced iron at an appropriate hot-forming temperature with a briquetting machine.

18 Claims, 2 Drawing Sheets

FOREIGN PATENT DOCUMENTS

| | | |
|---|---|---|
| JP | 52-78610 | 7/1977 |
| JP | 7 42523 | 5/1995 |
| JP | 11 27611 | 1/1999 |
| JP | 2000 309840 | 11/2000 |
| JP | 2001 181721 | 7/2001 |
| JP | 2001 255068 | 9/2001 |
| JP | 2001330379 | * 11/2001 |
| JP | 2002 38211 | 2/2002 |
| JP | 2003 27149 | 1/2003 |
| SU | 506556 | 5/1976 |

OTHER PUBLICATIONS

Ujisawa, Yutaka et al., "Effect of HBI Utilization on Blast Furnace Productivity", Tetsu-To-Hagane, vol. 92, No. 10, pp. 591-600, 2006, (with English abstract).

Sugiyama, Ken et al., "Dust treatment by Fastmet method", Shigen (Resources), and Sozai (Material), Autumn Meeting, Sapporo, 4 pp., Sep. 24-26, 2006, (with partial English translation).

Extended European Search Report issued Sep. 28, 2010, in Application No. 08832227.6-1215/2210960 PCT/JP2008066044.

* cited by examiner

METHOD FOR PRODUCING HOT BRIQUETTE IRON USING HIGH-TEMPERATURE REDUCED IRON AND METHOD AND APPARATUS FOR CONTROLLING TEMPERATURE OF REDUCED IRON FOR HOT FORMING

This application is a national stage of PCT/JP08/66044 filed on Sep. 5, 2008.

TECHNICAL FIELD

The present invention relates to a method for producing hot briquette iron (may be abbreviated to "HBI" hereinafter) by hot-forming high-temperature reduced iron which is obtained by heating reduction of agglomerates incorporated with a carbonaceous material in a reducing furnace such as a rotary hearth furnace or the like, and to a method and apparatus for controlling the temperature of reduced iron used for producing the hot briquette iron to a temperature suitable for hot forming.

BACKGROUND ART

In recent, hot briquette iron (may be referred to as "HBI" hereinafter) has attracted attention as a raw material to be charged in a blast furnace which can cope with problems of both the recent tendency to higher tapping ratio operations and reduction of $CO_2$ emission (refer to, for example, Non-patent Document 1).

However, conventional HBI is produced by hot forming of so-called gas-based reduced iron (reduced iron may be abbreviated to "DRI" hereinafter) which is produced by reducing fired pellets with high iron grade, which is used as a raw material, with reducing gas produced by reforming natural gas in a countercurrent heating-type reducing furnace such as a shaft furnace or the like. Therefore, conventional gas-based HBI is used as a raw material alternative to scraps in electric furnaces, but has a problem in practical use because of its high cost as a raw material for blast furnaces.

On the other hand, there has recently been developed a technique for producing so-called coal-based DRI by reducing a low-grade iron raw material with agglomerates incorporated with a carbonaceous material, which contain inexpensive coal as a reductant, in a high-temperature atmosphere of a radiation heating-type reducing furnace such as a rotary hearth furnace or the like, and practical application of the technique has been advanced (refer to, for example, Patent Documents 1 and 2).

However, the coal-based DRI is produced using a carbonaceous material incorporated as a reductant and thus has high porosity and a high content of residual carbon as compared with gas-based DRI. Therefore, the coal-based DRI has lower strength. Therefore, under the present conditions, in order to provide coal-based DRI with strength enough to resist charging in a blast furnace, the amount of the carbonaceous material incorporated is decreased to extremely decrease the residual C content in DRI, and strength is secured even by the sacrifice of metallization (refer to FIG. 3 of Non-patent Document 2). In addition, like the conventional gas-based DRI, the coal-based DRI is easily re-oxidized, and thus the coal-based DRI is unsuitable for long-term storage and long-distance transport.

Therefore, it is thought that like the conventional gas-based DRI, coal-based DRI is briquetted (i.e., to produce HBI) for the purpose of imparting higher strength and reoxidation resistance (weather resistance).

However, the briquetting has a problem in temperature control. Reduced iron discharged from a reducing furnace is at a high temperature, for example, about 750° C. to 900° C. in a current gas-based DRI production method using a countercurrent heating reducing furnace and about 1000° C. to 1100° C. in a coal-based DRI production method using a radiation heating-type reducing furnace. When such high-temperature reduced iron discharged from a reducing furnace is supplied in a hot state to a briquetting machine without substantially being cooled like in the present gas-based DRI production method, there occur various problems, for example, that the temperature of the reduced iron exceeds the limit of heat resistance of a briquetting roll and that the reduced iron is fixed in a pocket of the briquetting roll and is not easily separated.

A conceivable method for solving the problems include cooling, to some extent, high-temperature reduced iron discharged from a reducing furnace and then hot-forming the iron. However, when the reduced iron is excessively cooled, the reduced iron is hardened to worsen formability, thereby causing problems, such as the need to increase forming pressure, the occurrence of cracks in produced HBI, and the like.

Further, Patent Documents 3 to 5 disclose cooling methods using a rotary kiln, but any one of the methods aims at cooling high-temperature reduced pellets to finally room temperature, and the documents do not disclose means for solving the problems.

Non-Patent Document 1: Y Ujisawa, et al. Iron & Steel, vol. 92 (2006), No. 10, p. 591-600

Non-Patent Document 2: Takeshi Sugiyama et al. "Dust Treatment by FASTMET (R) Process", Resource Material (Shigen Sozai) 2001 (Sapporo), Sep. 24-26, 2001, 2001 Autumn Joint Meeting of Resource Materials-Related Society (Shigen Sozai Kankeigaku Kyokai)

Patent Document 1: Japanese Unexamined Patent Application Publication No 11-279611

Patent Document 2: Japanese Unexamined Patent Application Publication No 2001-181721

Patent Document 3: Japanese Examined Patent Application Publication No 7-42523

Patent Document 4: Japanese Unexamined Patent Application Publication No 2002-38211

Patent Document 5: Japanese Unexamined Patent Application Publication No 2001-255068

DISCLOSURE OF INVENTION

The present invention provides a method capable of satisfactorily producing hot-briquette iron using high-temperature reduced iron which is obtained by reducing agglomerates incorporated with a carbonaceous material, and also provides a method and apparatus for controlling the temperature of reduced iron used for producing the hot briquette iron to a temperature suitable for producing the hot briquette iron.

In order to achieve the object, the basic concept of the present invention is that reduced iron discharged at a high temperature of about 1000° C. to 1100° C. from a radiation heating-type reducing furnace is precisely cooled to a temperature over 600° C. (preferably 650° C. or more) and 750° C. or less suitable for hot-forming with a briquetting machine and then hot-formed.

Specifically, a method for producing hot-briquette iron by hot-forming high-temperature reduced iron reduced in a reducing furnace includes a temperature control step of cooling the high-temperature reduced iron and controlling the temperature of the reduced iron to an appropriate hot-forming temperature of over 600° C. and 750° C. or less, and a step of producing hot briquette iron by hot-forming the high-temperature reduced iron of the appropriate hot-forming temperature with a briquetting machine. The temperature control step includes substantially horizontally maintaining a rotating drum having a feed blade spirally provided on the inner periphery thereof, charging the high-temperature reduced iron in the rotating drum and passing it through the rotating drum by rotating the rotating drum while maintaining the inside of the rotating drum in a non-oxidizing atmosphere with inert gas, and cooling the outer peripheral surface of the rotating drum with a cooling fluid by contact with the cooling fluid during the passage of the high-temperature reduced iron through the rotating drum to indirectly cool the reduced iron so that the temperature of the reduced iron is the appropriate hot-forming temperature.

This method is capable of securely precisely controlling the temperature of reduced iron to a temperature suitable for a subsequent hot-forming step by an indirect cooling method of cooling the outer periphery of a rotating drum with a cooling fluid while maintaining the inside of the rotating drum in a non-oxidizing atmosphere with inert gas, thereby permitting the production of good hot briquette iron.

BEST MODE FOR CARRYING OUT THE INVENTION

Embodiments of the present invention are described in detail below with reference to the drawings.

First Embodiment

Figure 1:
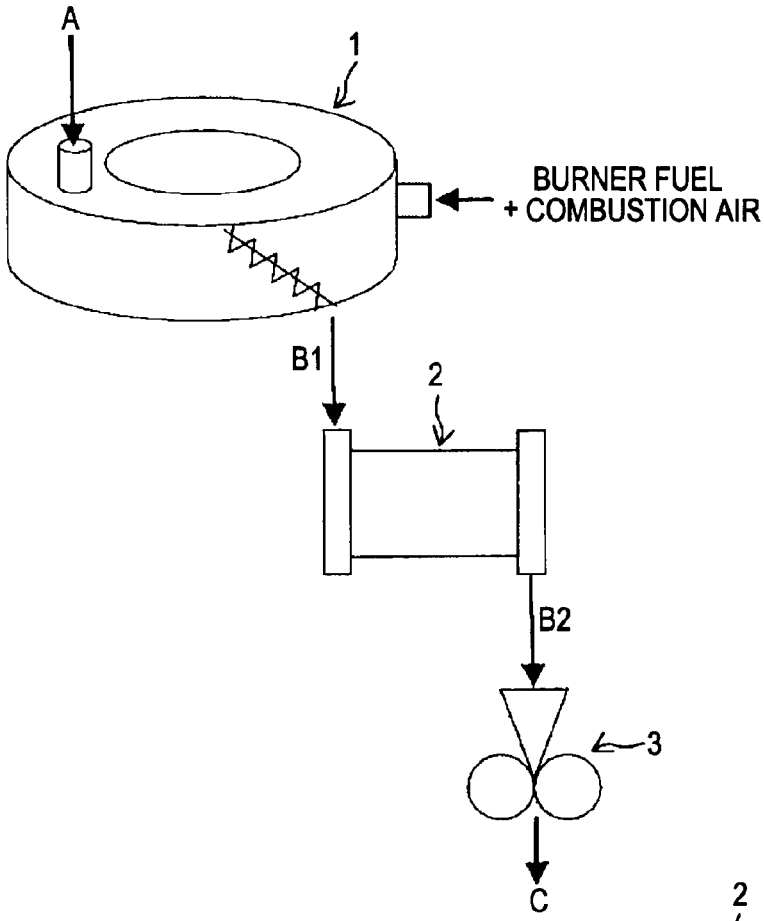
FIG. 1 is a flow chart showing outlines of a production process for HBI according to an embodiment of the present invention.

FIG. 1 is a flow chart showing a schematic configuration of a production process for HBI according to an embodiment of the present invention. This production process uses a rotary hearth furnace (1) serving as a reducing furnace for heat-reducing iron oxide agglomerates (A) incorporated with a carbonaceous material at a temperature of about 1100° C. to 1300° C. to produce high-temperature reduced iron (B1), a rotary cooler (2) for cooling the high-temperature reduced iron (B1) to a temperature suitable for hot forming, and a hot briquetting machine (3) for forming, under hot compression, the cooled reduced iron (referred to as "cooled reduced ion" hereinafter) (B2) to HBI. Hereinafter, the reduced iron in the rotary cooler is simply referred to as "reduced iron (B)" in order to discriminate from the high-temperature reduced iron (B1) and the cooled reduced iron (B2).

Figure 2:
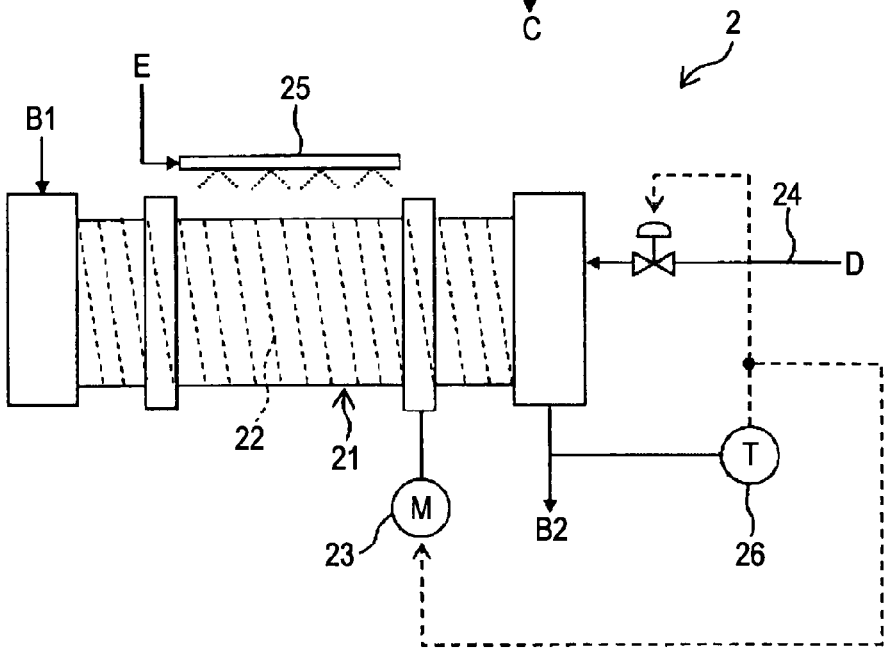
FIG. 2 is a front view showing a schematic configuration of a rotary cooler according to a first embodiment of the present invention.

As shown in FIG. 2, the rotary cooler (2) is provided with a cylindrical rotating drum (21) and an inverter motor (23). The rotating drum (21) has an inner peripheral surface on which a spiral feed blade (22) is provided. The rotating drum (21) is rotatably installed in a substantially horizontal state and is rotated by the inverter motor (23). The rotating drum (21) has an inlet for charging the high-temperature reduced iron (B1) therein so that the charged high-temperature reduced iron (B1) is transferred to an outlet of the rotating drum (21) by leading by the feed blade (22) with rotation of the rotating drum (21).

The rotary cooler (2) is further provided with a nitrogen gas supply line (24), a cooling water supply device (25), and a thermometer (26). The nitrogen gas supply line (24) is adapted for supplying nitrogen gas (D) as inert gas into the rotating drum (21) to maintain the inside of the rotating drum (21) in a non-oxidizing atmosphere, and a flow rate operation valve (28) is provided at an intermediate position. The cooling water supply device (25) is adapted for cooling the outer periphery of the rotating drum (21) by spraying cooling water (E) as a cooling fluid to the outer periphery of the rotating drum (21). The thermometer (26) is installed at the outlet of the rotating drum (21) and has the function to measure the temperature (hereinafter, referred to as the "cooling temperature") of the cooled reduced iron (B2) at the outlet and output a control signal to the inverter motor (23) and/or the flow rate operation valve (28) of the nitrogen gas supply line (24) to control the rotational speed of the rotating drum (21) and/or the supply flow rate of nitrogen gas (D) to the rotating drum (21) so that the measured value is a temperature suitable for hot forming.

The high-temperature reduced iron (B1) of about 1000° C. to 1100° C. discharged from the rotary hearth furnace (1) is charged in the rotating drum (21) of the rotary cooler (2) and cooled by an indirect cooling method through the rotating drum (21) in which the outer peripheral surface is cooled with water during the passage through the rotating drum (21) with rotation of the rotating drum (21). As a result, the high-temperature reduced iron (B1) becomes the cooled reduced iron (B2) cooled to a temperature of over 600° C. (preferably 650° C. or more) and 750° C. or less suitable for hot-forming with the briquetting machine (3) in a next step, and is then discharged from the rotary cooler (2).

The reduced iron (B) can be controlled to the temperature suitable for hot forming by cooling (i.e., control of the cooling temperature of the cooled reduced iron (B2)) by adjusting at least one of the rotational speed of the rotating drum (21) and the supply flow rate of nitrogen gas (D) to the rotating drum (21) according to the production rate of the high-temperature reduced iron (B1) and the charging temperature of the high-temperature reduced iron (B1) into the rotating drum (21).

Specifically, with respect to adjustment of the rotational speed of the rotating drum (21), for example, the transfer speed of the reduced iron (B) with the spiral feed blade (22) is increased by increasing the rotational speed of the rotating drum (21), thereby decreasing the retention time of the reduced iron (B) in the rotating drum (21). This decreases the degree of cooling of the reduced iron (B2) (i.e., increases the cooling temperature of the reduced iron (B2)).

In addition, with respect to adjustment of the supply flow rate of the nitrogen gas (D) to the rotating drum (21), for example, the linear speed of the nitrogen gas (D) in the rotating drum (21) is increased by increasing the supply flow rate of the nitrogen gas (D), thereby increasing the coefficient of heat transfer between the reduced iron (B) and the nitrogen gas (D) and decreasing the average temperature of the nitrogen gas (D) in the rotating drum (21) to enlarge a difference between the average temperature and the temperature of the reduced iron (B). This increases the degree of cooling of the reduced iron (B2) (i.e., decreases the cooling temperature of the reduced iron (B2)).

It is necessary to design the specifications of the rotary cooler (2) according to the production capacity (maximum production rate) of the rotary hearth furnace (1) for the high-temperature reduced iron (B1). For example, on the assumption that full-production of the high-temperature reduced iron (B1) in the rotary hearth furnace (1) is performed at the minimum rotational speed of the rotating drum (21) and the maximum supply flow rate of the nitrogen gas (D), the rotary cooler (2) may be designed to have the ability of cooling the high-temperature reduced iron (B1) of the highest temperature (e.g., 1100° C.) to the minimum temperature (650° C.) as the temperature suitable for hot forming.

In the rotary cooler (2), as the production rate of the high-temperature reduced iron (B1) in the rotary hearth furnace (1) decreases from the full-production rate, for example, an operation of decreasing the supply flow rate of the nitrogen gas (D) from the maximum value to the minimum value is first performed. Next, an operation of increasing the rotational speed of the rotating drum (21) from the minimum value to the maximum value may be performed. These operations realize secured and precise control of the cooling temperature of the reduced iron (B2) to the appropriate hot-forming temperature according to the production rate of the high-temperature reduced iron (B1) in the rotary hearth furnace (1).

Modified Example

Although, in the first embodiment, the rotary hearth furnace is used as a radiation-type reducing furnace, another radiation-type reducing furnace, such as a rotary kiln, may be used in the present invention. Further, not only the radiation-type reducing furnace but also a countercurrent-type heat reducing furnace used in a gas-based DRI producing method is capable of operation at a higher temperature than in the present conditions, and the present invention can be effectively applied when the temperature of the reduced iron discharged from the reducing furnace is increased.

Although, in the first embodiment, nitrogen gas is used as inert gas, any gas can be used as long as it does not substantially contain oxygen, and for example, a rotary hearth furnace exhaust gas after cooling can be used.

Although, in the first embodiment, water (cooling water) is used as the cooling fluid, for example, air may be used in place of water when the reduced iron is excessively cooled with the cooling water due to significant decrease in the production rate of the high-temperature reduced iron. When air is used, heated air is recovered so that its sensible heat can be effectively used as, for example, combustion air for a heating burner of a rotary hearth furnace.

Although, in the first embodiment, the operation of increasing the rotational speed of the rotating drum is performed after the operation of decreasing the supply flow rate of nitrogen gas to the minimum value, these operations may be performed in the reverse order or may be simultaneously performed.

Although, in the first embodiment, control to the appropriate hot-forming temperature by cooling is performed by controlling the rotational speed of the rotating drum and/or the supply flow rate of invert gas, the temperature control can be performed by adjusting the temperature of the cooling water in stead of or in addition to the above method. For example, an increase in temperature of the cooling water decreases the amount of heat absorbed by evaporation of part of the cooling water and decreases the amount of heat removed from the outer peripheral surface of the rotating drum, so that the degree of cooling of the reduced iron can be decreased (the cooling temperature of the cooled reduced iron can be increased).

Second Embodiment

In the first embodiment (including modified examples), cooling to the appropriate hot-forming temperature is performed by adjusting at least one of the rotational speed of the rotating drum (21), the supply flow rate of the nitrogen gas (D), and the temperature of the cooling water (E). However, in a second embodiment, in addition to this adjustment, the quantity of radiant heat transfer from the layer surface of the reduced iron (B) to the inner peripheral surface of the rotating drum (21) is adjusted. Therefore, means for adjusting a geometrical factor of heat radiation from a layer surface of the reduced iron (B) to the inner peripheral surface of the rotating drum (21) is provided in the rotating drum (21).

Figure 3:
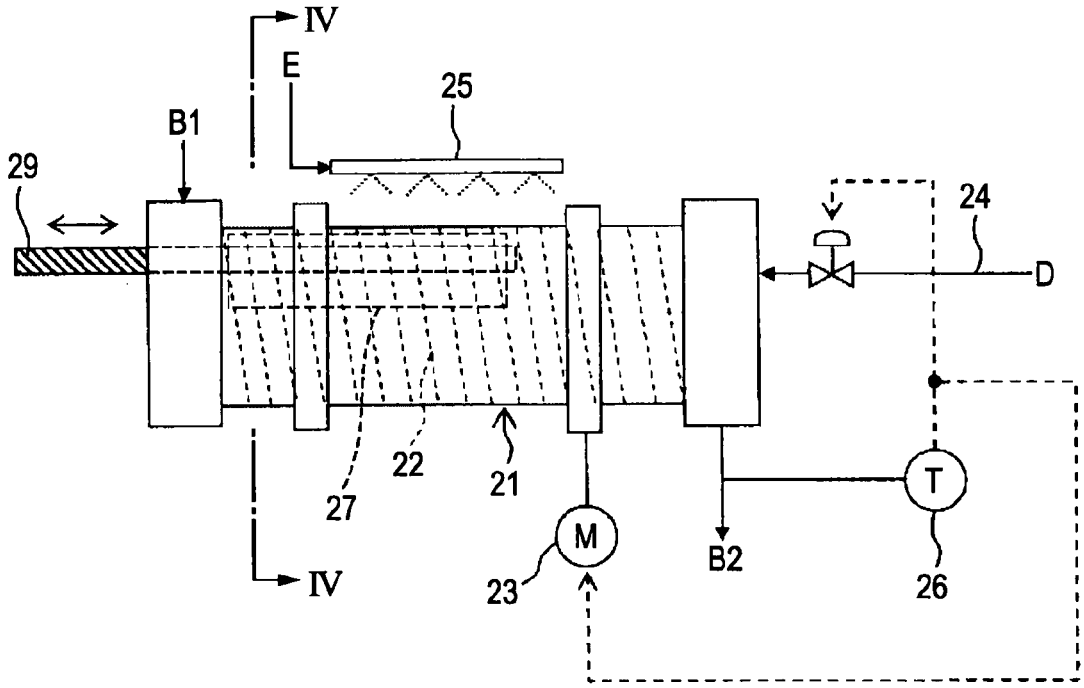
FIG. 3 is a front view showing a schematic configuration of a rotary cooler according to a second embodiment of the present invention.
Figure 4:
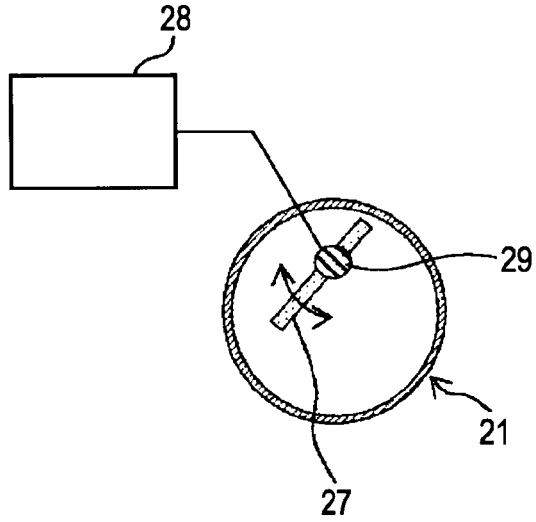
FIG. 4 is a sectional view taken along line IV-IV in FIG. 3.

In an example shown in FIGS. 3 and 4, the means for adjusting the geometrical factor includes a shielding member inserted into the rotating drum (21) and a shielding plate operating device (28). The shielding member includes a spindle (29) extending in a direction substantially parallel to the axial direction of the rotating drum (21), and a shielding plate (27) extending along the spindle (29) and fixed to the spindle (29). The shielding plate operating device (28) allows at least one of movement of the spindle (29) in the axial direction and rotation around its axis to change at least one of the insertion length of the shielding plate (27) and the inclination angle of the shielding plate (27) with respect to a horizontal plane.

The change in the insertion length of the shielding plate (27) and/or the inclination angle of the shielding plate (27) with a horizontal plane changes the geometrical factor of heat radiation from the layer surface of the reduced iron (B) to the inner peripheral surface of the rotating drum (21), thereby significantly changing the quantity of radiant heat transfer from the layer surface of the reduced iron (B) to the inner peripheral surface of the rotating drum (21). The shielding plate (27) is preferably inserted on the high-temperature side (inlet side of the reduced iron (B)) in the rotating drum (21) so that the rate of change in the quantity of radiant heat transfer can be more increased than insertion on the low-temperature side (outlet side of the reduced iron (B)) in the rotating drum (21).

Even when the production rate of the high-temperature reduced iron (B1) in the rotary hearth furnace (1) is significantly changed, the high-temperature reduced iron (B1) can be securely and precisely cooled to the appropriate hot-forming temperature with only the rotary cooler (2) by a combination of the geometrical factor control means and the means for controlling each of the rotational speed of the rotating drum (21), the supply flow rate of the nitrogen gas (D), and the temperature of the cooling water (E) which are described in the first embodiment.

Modified Example

Instead of or in addition to the movable shielding plate according to the second embodiment, the means for adjusting the geometrical factor may include a heat insulator detachably disposed on the inner peripheral surface of the rotating drum. The geometrical factor is changed by changing the installation area for the heat insulator.

Example

In order to confirm the advantage of the present invention, a cooling test of high-temperature reduced iron was conducted as described below.

[Test Method and Test Condition]

Reduced iron pellets simulated for high-reduced iron reduced with a radiation-type heating reducing furnace were used. Specifically, reduced iron pellets at room temperature which were produced by reducing iron oxide pellets incorporated with a carbonaceous material composed of ironworks dust and pulverized coal were continuously supplied at a predetermined feed rate by a constant feeder, heated to 1000° C. in a rotary heating furnace, and used in a heated state.

The reduced iron pellets heated to 1000° C. were continuously supplied to a rotary cooler provided with a rotating drum having an outer diameter of 0.3185 m and a total length of 0.8 m and a spiral feed blade provided on the inner peripheral surface of the rotating drum. When the high-temperature reduced iron was cooled, the rotational speed of the rotating drum, the supply flow rate of nitrogen gas into the rotating drum, and the temperature and spray length of the cooling water were variously changed while spraying the cooling water at a supply rate of 0.4 $m^3$/h (constant) within a predetermined length range of the outer peripheral surface of the rotating drum. The temperature of the cooled reduced iron discharged from the outlet of the rotating drum was measured.

[Test Results]

The test results are shown in Table 1. As shown in the table, it was confirmed that the temperature of cooled reduced iron (outlet temperature of the rotating drum) can be controlled by adjusting the rotational speed of the rotating drum (Test Nos. 1 to 3), the nitrogen gas supply flow rate (Test Nos. 1 and 4), and the temperature of the cooling water (Test Nos. 1 and 5).

It was also confirmed that when the supply rate of high-temperature reduced iron is decreased from 200 kg/h to 120 kg/h, the temperature of the cooled reduced iron cannot be controlled to a temperature range of 650° to 750° C. suitable for hot forming only by adjusting the rotational speed of the rotating drum (Test Nos. 6 to 8) but can be controlled to the temperature range suitable for hot forming by shortening the water spray length (Test No. 9). This result indicates that means for controlling the geometrical factor of heat radiation to the inner peripheral surface of the rotating drum enhances control performance.

TABLE 1

| | High-temperature reduced iron | | Cooling water | | Cooling nitrogen gas | | Rotating drum | | |
|---|---|---|---|---|---|---|---|---|---|
| Test No. | Supply rate (kg/h) | Inlet temperature (° C.) | Flow rate ($m^3$/h) | Temperature (° C.) | Flow rate ($Nm^3$/h) | Temperature (° C.) | Water spray length (m) | Rotational speed (rpm) | Reduced iron outlet temperature (° C.) |
| 1 | 200 | 1000 | 0.4 | 25 | 0 | — | 0.25 | 1.0 | 700 |
| 2 | 200 | 1000 | 0.4 | 25 | 0 | — | 0.25 | 0.5 | 674 |
| 3 | 200 | 1000 | 0.4 | 25 | 0 | — | 0.25 | 2.0 | 725 |
| 4 | 200 | 1000 | 0.4 | 25 | 10 | 25 | 0.25 | 1.0 | 662 |
| 5 | 200 | 1000 | 0.4 | 70 | 0 | — | 0.25 | 1.0 | 714 |
| 6 | 120 | 1000 | 0.4 | 25 | 0 | — | 0.25 | 1.0 | 554 |
| 7 | 120 | 1000 | 0.4 | 25 | 0 | — | 0.25 | 0.5 | 520 |
| 8 | 120 | 1000 | 0.4 | 25 | 0 | — | 0.25 | 2.0 | 586 |
| 9 | 120 | 1000 | 0.4 | 25 | 0 | — | 0.15 | 1.0 | 698 |

As described above, the present invention provides a method for satisfactorily producing hot briquette iron by hot-forming high-temperature reduced iron reduced in a reducing furnace. This method includes a temperature control step of cooling the high-temperature reduced iron and controlling the temperature of the reduced iron to an appropriate hot-forming temperature of over 600° C. and 750° C. or less, and a step of producing hot briquette iron by hot-forming the high-temperature reduced iron of the appropriate hot-forming temperature with a briquetting machine. The temperature control step includes substantially horizontally holding a rotating drum having a feed blade spirally provided on the inner periphery thereof, charging the high-temperature reduced iron in the rotating drum and passing it through the rotating drum by rotating the rotating drum while maintaining the inside of the rotating drum in a non-oxidizing atmosphere with inert gas, and cooling the outer peripheral surface of the rotating drum by contact with a cooling fluid during the passage of the high-temperature reduced iron through the rotating drum to indirectly cool the reduced iron so that the temperature of the reduced iron is the appropriate hot-forming temperature.

Also, the present invention provides a method for controlling the temperature of the high-temperature reduced iron to the temperature suitable for the hot forming when the hot briquette iron is produced, the method including substantially horizontally holding a rotating drum having a feed blade spirally provided on the inner periphery thereof, charging the high-temperature reduced iron in the rotating drum and passing it through the rotating drum by rotating the rotating drum while maintaining the inside of the rotating drum in a non-oxidizing atmosphere with inert gas, and cooling the outer peripheral surface of the rotating drum by contact with a cooling fluid during the passage of the high-temperature reduced iron through the rotating drum to indirectly cool the reduced iron so that the temperature of the reduced iron is the appropriate hot-forming temperature of over 600° C. and 750° C. or less.

This method is capable of securely precisely controlling the temperature of reduced iron to a temperature suitable for a subsequent hot-forming step by an indirect cooling method of cooling the outer periphery of a rotating drum with a cooling fluid while maintaining the inside of the rotating drum in a non-oxidizing atmosphere with inert gas, thereby permitting the production of good hot briquette iron.

As the cooling fluid, for example, water or air is preferred.

The temperature of the high-temperature reduced iron can be controlled to the temperature suitable for hot forming by controlling at least one of the rotational speed of the rotating drum, the supply flow rate of the inert gas to the rotating drum, and the temperature of the cooling fluid.

When the temperature of the high-temperature reduced iron is controlled by further adjusting a geometrical factor of heat radiation from a layer surface of the reduced iron to the inner peripheral surface of the rotating drum, control performance is further improved.

Specifically, the geometrical factor can be adjusted by inserting a shielding member into the rotating drum along the axial direction thereof and adjusting at least one of the insertion length of the shielding member into the rotating drum and the inclination angle of the shielding member with a horizontal plane. In addition, the geometrical factor may be adjusted by installing a heat insulator detachably on the inner peripheral surface of the rotating drum and adjusting the installation area for the heat insulator.

Also, the present invention provides an apparatus for controlling the temperature of the high-temperature reduced iron to a temperature suitable for the hot forming, the apparatus including a rotating drum substantially horizontally held and having a feed blade spirally provided on the inner peripheral surface thereof, inert gas supply means for supplying inert gas into the rotating drum to maintain the inside of the rotating drum in a non-oxidizing atmosphere, drum driving means for rotating the rotating drum to move the high-temperature reduced iron charged in the rotating drum and pass the reduced iron in the rotating drum, cooling means for cooling the outer periphery of the rotating drum by contact with a cooling fluid to indirectly cool the reduced iron during the passage of the high-temperature reduced iron through the rotating drum, and temperature control means for measuring the temperature of the reduced iron at the outlet of the rotating drum and adjusting at least one of the rotational speed of the rotating drum and the supply flow rate of inert gas to the rotating drum so that the measured value is an appropriate hot-forming temperature of over 600° C. and 750° C. or less.

The temperature control apparatus preferably further includes geometrical factor changing means for changing the geometrical factor of heat radiation from the layer surface of the reduced iron to the inner peripheral surface of the rotating drum, and the temperature control means more preferably operates the geometrical factor changing means so that the measured temperature value of the reduced iron is an appropriate hot-forming temperature of over 600° C. and 750° C. or less.

The geometrical factor changing means preferably includes a shielding member inserted into the rotating drum along the axial direction thereof and shielding member operating means for changing at least one of the insertion length of the shielding member and the inclination angle of the shielding member with a horizontal plane.

The invention claimed is:

1. A method for producing hot briquette iron by hot-forming high-temperature reduced iron reduced in a reducing furnace, the method comprising a temperature control step of cooling the high-temperature reduced iron and controlling the temperature of the reduced iron to an appropriate hot-forming temperature of over 600° C. and 750° C. or less, and a step of producing hot briquette iron by hot-forming the high-temperature reduced iron at the appropriate hot-forming temperature with a briquetting machine;

wherein the temperature control step includes substantially horizontally holding a rotating drum having a feed blade spirally provided on the inner periphery thereof;

charging the high-temperature reduced iron in the rotating drum and passing it through the rotating drum by rotating the rotating drum while maintaining the inside of the rotating drum in a non-oxidizing atmosphere with inert gas; and cooling the outer peripheral surface of the rotating drum by contact with a cooling fluid during the passage of the high-temperature reduced iron through the rotating drum to indirectly cool the reduced iron so that the temperature of the reduced iron is the appropriate hot-forming temperature, wherein the temperature of the high-temperature reduced iron is controlled by adjusting at least one of a rotational speed of the rotating drum, a supply flow rate of the inert gas to the rotating drum, and the temperature of the cooling fluid.

2. The method for producing hot briquette iron according to claim 1, wherein the cooling fluid is water or air.

3. The method for producing hot briquette iron according to claim 1, wherein the temperature of the high-temperature reduced iron is controlled by further adjusting a geometrical factor of heat radiation from a layer surface of the reduced iron to the inner peripheral surface of the rotating drum.

4. The method for controlling the temperature of reduced iron for hot forming according to claim 1, wherein the temperature of the high-temperature reduced iron is controlled by further adjusting a geometrical factor of heat radiation from a layer surface of the reduced iron to the inner peripheral surface of the rotating drum.

5. The method for controlling the temperature of reduced iron for hot forming according to claim 4, wherein the geometrical factor is controlled by inserting a shielding member into the rotating drum along the axial direction thereof and controlling at least one of the insertion length of the shielding member into the rotating drum and the inclination angle of the shielding member with a horizontal plane.

6. The method for controlling the temperature of reduced iron for hot forming according to claim 4, wherein the geometrical factor is adjusted by installing a heat insulator detachably on the inner peripheral surface of the rotating drum and adjusting the installation area for the heat insulator.

7. The method for producing hot briquette iron according to claim 1, wherein the temperature of the high-temperature reduced iron is controlled by adjusting the rotational speed of the rotating drum.

8. The method for producing hot briquette iron according to claim 1, wherein the temperature of the high-temperature reduced iron is controlled by the supply flow rate of the inert gas to the rotating drum.

9. The method for producing hot briquette iron according to claim 1, wherein the temperature of the high-temperature reduced iron is controlled by the temperature of the cooling fluid.

10. A method for controlling the temperature of high-temperature reduced iron reduced in a reducing furnace to a temperature suitable for hot forming when hot briquette iron is produced by the hot forming of the high-temperature reduced iron, the method comprising:

substantially horizontally holding a rotating drum having a feed blade spirally provided on the inner periphery thereof;

charging the high-temperature reduced iron in the rotating drum and passing it through the rotating drum by rotating the rotating drum while maintaining the inside of the rotating drum in a non-oxidizing atmosphere with inert gas; and cooling the outer peripheral surface of the rotating drum by contact with a cooling fluid during the passage of the high-temperature reduced iron through the rotating drum to indirectly cool the reduced iron so that the temperature of the reduced iron is the appropriate hot-forming temperature of over 600° C. and 750° C. or less, wherein the temperature of the high-temperature reduced iron is controlled by adjusting at least one of a rotational speed of the rotating drum, supply flow rate of the inert gas to the rotating drum, and temperature of the cooling fluid.

11. The method for controlling the temperature of reduced iron for hot forming according to claim 10, wherein the cooling fluid is water or air.

12. The method according to claim 10, wherein the temperature of the high-temperature reduced iron is controlled by adjusting the rotational speed of the rotating drum.

13. The method according to claim 10, wherein the temperature of the high-temperature reduced iron is controlled by the supply flow rate of the inert gas to the rotating drum.

14. The method according to claim 10, wherein the temperature of the high-temperature reduced iron is controlled by the temperature of the cooling fluid.

15. An apparatus for controlling the temperature of the high-temperature reduced iron reduced in a reducing furnace to a temperature suitable for the hot forming when hot briquette iron is produced by the hot forming of the high-temperature reduced iron, the apparatus comprising:

a rotating drum substantially horizontally held and having a blade spirally provided on the inner peripheral surface thereof;

inert gas supply means for supplying inert gas into the rotating drum to maintain the inside of the rotating drum in a non-oxidizing atmosphere;

drum driving means for rotating the rotating drum to move the high-temperature reduced iron charged in the rotating drum and pass the reduced iron in the rotating drum;

cooling means for cooling the outer periphery of the rotating drum by contact with a cooling fluid to indirectly cool the reduced iron during the passage of the high-temperature reduced iron through the rotating drum; and temperature control means for measuring the temperature of the reduced iron at an outlet of the rotating drum and adjusting at least one of the rotational speed of the rotating drum and the supply flow rate of inert gas to the rotating drum so that the measured value is an appropriate hot-forming temperature of over 600° C. and 750° C. or less.

16. The apparatus for controlling the temperature of reduced iron for hot forming according to claim 15, further comprising geometrical factor changing means for changing a geometrical factor of heat radiation from a layer surface of the reduced iron to the inner peripheral surface of the rotating drum;

wherein the temperature control means operates the geometrical factor changing means so that the measured temperature value of the reduced iron is the appropriate hot-forming temperature of over 600° C. and 750° C. or less.

17. The apparatus for controlling the temperature of reduced iron for hot forming according to claim 16, wherein the geometrical factor changing means includes a shielding member inserted into the rotating drum along the axial direction thereof and shielding member operating means for changing at least one of the insertion length of the shielding member and the inclination angle of the shielding member with a horizontal plane.

18. The apparatus for controlling the temperature of reduced iron for hot forming according to claim 15, wherein the inert gas supply means is a nitrogen supply means and the inert gas is nitrogen.

* * * * *